United States Patent [19]

Metcalf

[11] 4,236,872

[45] Dec. 2, 1980

[54] MARINE PROPELLER FISH LINE AND WEED CUTTER

[75] Inventor: Silas L. Metcalf, Waukegan, Ill.

[73] Assignee: Outboard Marine Corporation, Waukegan, Ill.

[21] Appl. No.: 923,177

[22] Filed: Jul. 10, 1978

[51] Int. Cl.[3] ..... B63H 1/26

[52] U.S. Cl. ..... 416/146 R; 416/93 A; 416/134 R

[58] Field of Search ..... 416/146 R, 146 B, 93 R, 416/134 R, 169 R

[56] References Cited

U.S. PATENT DOCUMENTS

| | | | |
|---|---|---|---|
| 1,390,397 | 9/1921 | Svenson | 416/146 B |
| 1,813,540 | 7/1931 | Laska | 416/146 B |
| 2,143,693 | 1/1939 | Harris | 416/146 B |
| 3,371,720 | 3/1968 | Blanchard | 416/146 R |
| 3,563,670 | 2/1971 | Knuth | 416/93 A |
| 3,619,083 | 11/1971 | Witte | 416/146 R |
| 3,871,324 | 3/1975 | Snyder | 416/93 A |
| 4,080,099 | 3/1978 | Snyder | 416/146 R |

*Primary Examiner*—Everette A. Powell, Jr.

*Attorney, Agent, or Firm*—Michael, Best & Friedrich

[57] ABSTRACT

Disclosed herein is a marine propulsion device comprising a lower unit including a gear case having a hollow interior and having at the rearward end thereof an inwardly extending inner circular surface defining an opening through which exhaust gases and engine cooling water are discharged from the lower unit, and a propeller shaft rotatably journaled in the gear case and including a portion extending rearwardly of the gear case. A propeller including a hub is mounted on the propeller shaft rearward portion for common rotation of the hub with the propeller shaft. The propeller also includes a forward portion adjacent the rearward end of the gear case, and a propeller blade extending radially outwardly from the hub. A thrust washer is carried by the propeller shaft in forward thrust transmitting engagement therewith and in forward thrust receiving engagement with the hub, and a sleeve is supported by the thrust washer and extends into an area adjacent the inner circular surface of the gear case, the sleeve having a cutting surface closely adjacent the forward portion of the propeller for cutting fish lines and weeds therebetween.

20 Claims, 8 Drawing Figures

MARINE PROPELLER FISH LINE AND WEED CUTTER

BACKGROUND OF THE INVENTION

The invention relates generally to marine propulsion devices such as outboard motors and stern drive units. More particularly, the invention relates to fish line and weed cutters for such devices.

Attention is directed to U.S. Pat. No. 4,180,368 issued Dec. 25, 1979.

Attention is also directed to the U.S. Kiekhaefer Pat. No. 3,102,506 issued Sept. 3, 1963 and to the U.S. Witte Pat. No. 3,619,083 issued Nov. 9, 1971, as well as to the prior construction disclosed hereinafter and shown in FIG. 1.

Attention is also directed to the U.S. Kashmerick Pat. No. 3,876,332 issued Apr. 8, 1975 and to the U.S. Kashmerick Pat. No. 3,937,073 issued Feb. 10, 1976.

Attention is further directed to the U.S. Snyder Pat. No. 4,080,099 issued Mar. 21, 1978.

SUMMARY OF THE INVENTION

The invention provides a marine propulsion device comprising a lower unit including a gear case having a hollow interior and having at the rearward end thereof an inwardly extending inner circular surface defining an opening through which exhaust gases and engine cooling water are discharged from the lower unit, and a propeller shaft rotatably journaled in the gear case and including a portion extending rearwardly of the gear case. A propeller including a hub is mounted on the propeller shaft rearward portion for common rotation of the hub with the propeller shaft. The propeller also includes a forward portion adjacent the rearward end of the gear case and a blade extending radially outwardly from the hub. A thrust washer is carried by the propeller shaft in forward thrust transmitting engagement therewith and in forward thrust receiving engagement with the hub, and a sleeve is supported by the thrust washer and extends into an area adjacent the inner circular surface of the gear case, the sleeve having a cutting surface closely adjacent the forward portion of the propeller for cutting fish lines and weeds therebetween.

The invention also provides a marine propulsion device comprising a lower unit including a gear case having a hollow interior and having at the rearward end thereof an inwardly extending inner circular surface defining an opening through which exhaust gases and engine cooling water are discharged from the lower unit, and a propeller shaft rotatably journaled in the gear case and including a portion extending rearwardly of the gear case. A propeller including an inner hub part is mounted on the propeller shaft rearward portion for common rotation of the inner part with the propeller shaft. The propeller also includes an outer hub part, a propeller blade connected to the outer hub and extending radially outwardly, and resilient means connecting the inner and outer hub parts for limited relative rotational movement therebetween. A thrust washer is carried by the propeller shaft in forward thrust transmitting engagement therewith, the thrust washer being rotatably driven by the inner hub part and being relatively rotationally movable with respect to the outer hub part of the propeller. A sleeve is supported by the thrust washer and extends into an area adjacent the inner circular surface of the gear case, the sleeve having a cutting surface positioned closely adjacent the propeller for cutting fish lines and weeds therebetween during relative rotational movement of the thrust washer and the propeller.

One of the principal features of the invention is the provision in the sleeve of a rearward circumferential surface having circumferentially spaced cutting teeth thereon.

Another of the principal features of the invention is the provision on the forward portion of a propeller of cutting teeth mating with the cutting teeth of the rearward surface of the sleeve.

In accordance with one embodiment of the invention, the hub includes an inner hub part mounted on the propeller shaft for rotation therewith, and an outer hub part including a forward circumferential surface positioned rearwardly of the sleeve, the forward circumferential surface supporting a plurality of circumferentially spaced cutting teeth in cutting relationship with the circumferentially spaced cutting teeth on the sleeve.

In accordance with one embodiment of the invention, the sleeve includes a skirt extending rearwardly and the skirt supports cutting teeth.

In accordance with one embodiment of the invention, the propeller blades each support thereon a forwardly projecting cutting tooth positioned in cutting relationship with the cutting teeth supported by the sleeve.

Other features and advantages of the embodiments of the invention will become known by reference to the following description, to the appended claims, and to the drawings.

THE DRAWINGS

PRIOR ART

Figure 1:
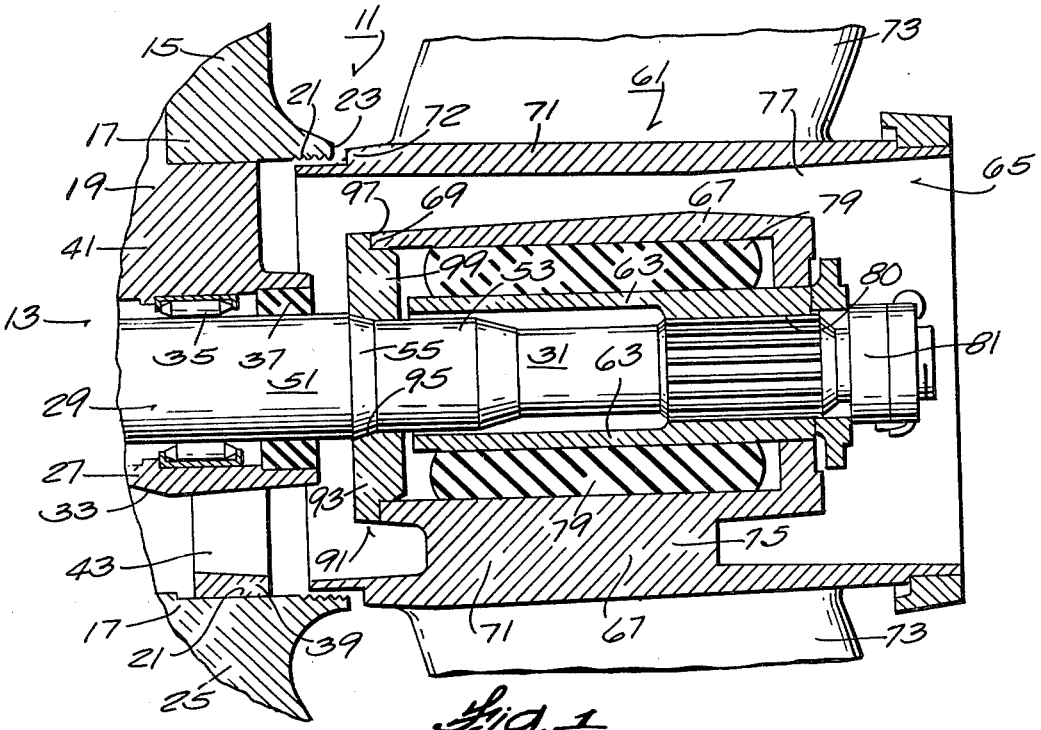
Fig. 1 PRIOR ART
FIG. 1 is a fragmentary side elevational view partially in section, of a prior marine propulsion device.

Shown fragmentarily in FIG. 1 of the drawings is a prior marine propulsion device 11, such as an outboard motor or a stern drive unit, including a lower unit 13 which, preferably, is mounted for both horizontal steering movement and vertical tilting movement.

The lower unit 13 includes a drive shaft housing 15 which, at its lower end, terminates in a gear box or case 17 which includes a hollow interior 19 having, at the rearward end thereof, an inner cylindrical surface 21 which can include, adjacent the rearward margin thereof, a series of convolutions and which terminates rearwardly at a rearwardly facing gear case edge or surface 23. Extending below the gear case 17 is a skeg 25.

Suitably fixed within the gear case 17 is a bearing retainer 27 which, in part, rotatably supports a propeller shaft 29 which includes a rearward portion 31 extending aft of the retainer 27 and the gear case 17. The retainer 27 can be fixed to the gear case 17 in any suitable manner, as disclosed, for instance, in the U.S. Kashmerick Pat. No. 3,937,073 issued Feb. 10, 1976 and includes a central hub portion 33 which supports one or more bearings, as for instance a series of roller bearings 35, and rearwardly of the bearings 35, a lubricant seal 37 between the retainer 27 and the propeller shaft 29.

The retainer 27 also includes an outer annular portion 39 which engages a part of the cylindrical inner surface 21 of the gear case 17 and which is supported from the central hub portion 33 by one or more ribs 41, for instance, two or three equi-angularly spaced ribs 41 can be employed. The area between the inner or central hub portion 33, the outer annular portion 39, and between the ribs 41 defines a plurality of openings or apertures 43 through which exhaust gases and engine cooling water are discharged from the drive shaft housing 15.

The propeller shaft portion 31 extending rearwardly of the bearing retainer 27 and gear case 17 includes a forward part 51 having a first diameter, a rearward part 53 having a second diameter of less dimension than the first diameter, and a thrust receiving transition part 55 which is located between the forward part 51 and rearward part 53 and which, in the disclosed construction, is conical in formation, but could be of other configurations.

Mounted on the rearward portion of the propeller shaft 29, rearwardly of the thrust receiving part 55, is a propeller 61 which includes an inner hub 63 received on the propeller shaft 29, together with an outer hub assembly 65 which includes an intermediate hub 67 having a forward end 69, and an outer hub 71 having a forward end 72 which can be stepped as shown and which extends somewhat into the hollow interior 19 of the gear case 17 in close proximity to the inner cylindrical surface 21 to substantially prevent the escape of exhaust gases and the entry of fish line and weeds. The outer hub assembly 65 also includes a series of propeller blades 73 extending from the outer hub 71, and a series of equi-angular spaced ribs or spokes 75 which interconnect the intermediate and outer hubs 67 and 71 to define a plurality of exhaust gas and engine cooling water discharge passages 77 which communicate with the apertures 43 in the bearing retainer 27. The outer hub assembly 65 is connected to the inner hub 61 by a resilient cushion or member 79 so as to absorb shock and to permit a limited amount of relative rotation between the inner hub assembly 63 and outer hub assembly 65.

Any suitable means, as for instance, a spline connection 80, can be employed to provide for common rotation of the propeller shaft 29 and the inner hub 63 of the propeller 61.

Any suitable means can be employed, such as a nut 81 to retain the propeller 61 on the propeller shaft 29 and to provide for transmission of reverse thrust from the intermediate hub 67 of the propeller 61 to the propeller shaft 29.

Forward propeller thrust is transmitted from the intermediate hub 67 of the propeller 61 to the propeller shaft 29 through a thrust washer 91. More particularly, the thrust washer 91 includes a central or hub portion 93 which is apertured to permit passage therethrough of the propeller shaft 29, which aperture is defined, in part, by a thrust transmitting surface 95 which engages the thrust receiving part 55 of the propeller shaft 29 for transmission of forward thrust from the thrust washer 91 to the propeller shaft 29.

The central portion 93 also includes an outer annular surface 97 extending generally perpendicular to the propeller axis and adapted for engagement with the forward end 69 of the intermediate hub 67 for transmission of forward thrust from the intermediate hub 67 of the propeller 61 to the thrust washer 91.

Still further, the central portion 93 includes a pilot part 99 which extends slightly into a recess in the propeller 61 between the inner and intermediate hubs 63 and 67 and which serves to assist in registry of the forward end 69 of the intermediate hub 67 with the thrust rings annular surface 97.

The above disclosed construction is prior art and is shown, at least in part, in U.S. Pat. No. 3,876,332 issued Apr. 8, 1975.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

GENERAL DESCRIPTION OF THE INVENTION

Figure 2:
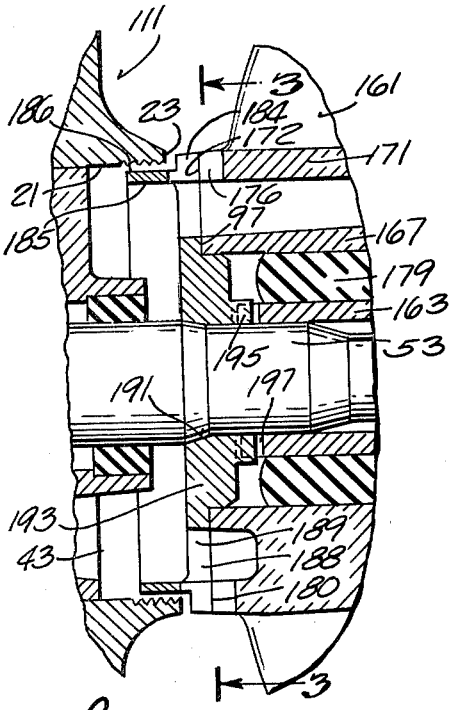
FIG. 2 is a fragmentary view similar to FIG. 1 illustrating a portion of a marine propulsion device which embodies various of the features of the invention.

Shown in FIG. 2 is a marine propulsion device 111 such as, for instance, an outboard motor or stern drive unit, which device is constructed in a similar manner to the device 11 shown in FIG. 1 except that a different propeller 161 is employed and a different thrust washer 191 is provided. A further difference is that the propeller 161 and the thrust washer 191 in combination provide fish line and weed cutting means therebetween, and the thrust washer 191 is connected to the inner hub 163 of the propeller 161 such that rotation of the inner hub 163 positively drives the thrust washer 191.

The components of the construction shown in FIG. 2 which are similar to those of the construction shown in FIG. 1 are identified with the same reference numerals and, hence, a description of these components in detail is not believed necessary in view of the foregoing description with respect to FIG. 1.

Figure 3:
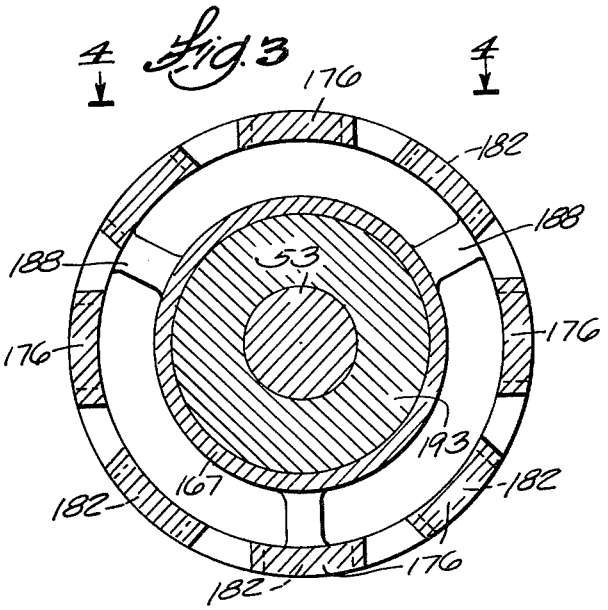
FIG. 3 is a cross-section taken along line 3—3 in FIG. 2.
Figure 4:
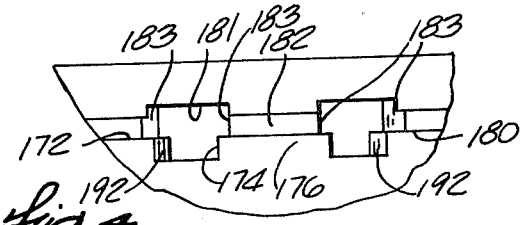
FIG. 4 is a cross-section view taken along line 4—4 in FIG. 3.

More specifically, the outer hub 171 of propeller 161 includes a leading cutting edge 172 spaced rearwardly from the rearwardly facing gear case edge or surface 23. As shown in FIGS. 3 and 4, a plurality of notches 174 are provided in the leading edge 172 of the outer hub 171 forming a series of cutting teeth 176 spaced around the circumference of the outer hub 171 and extending toward the rearwardly facing gear case edge 23.

The thrust washer 191 includes a radially outwardly spaced sleeve or collar 185 which extends forwardly from a hub portion 192 of the thrust washer 191. The collar 185 has an outer cylindrical surface 186 closely spaced in inward telescopic relation to a part of the inner cylindrical surface 21 of the gear case 17 so as to wipe the surface 21. The outer sleeve 185 is supported from the hub portion 193 of the thrust washer 191 by one or more ribs or spokes 188 which extend radially outwardly from the hub portion 193 of the thrust washer 191 to the outer sleeve 185 and which, together with the outer sleeve 185 and hub portion 193, define a series of passageways or openings 189 through which exhaust gas and engine coolant water are discharged from the apertures or openings 43. The outer sleeve 185 includes a rearward edge 180 (FIG. 4) in opposed mating relation with the leading edge 172 of the propeller 161. The rearward edge 180 includes therein a plurality of spaced apart notches 181 around the circumference of the outer sleeve 185, the notches 181 defining a plurality of cutting teeth 182 which are in opposed mating cutting relationship with the cutting teeth 176 of propeller 161. The cutting teeth 182 each include a radially outwardly projecting portion 184 extending radially from the surface 186 and positioned between the rearwardly facing gear case edge 23 and the cutting edge 172 of the propeller 161. The cutting teeth 182 each include planar shearing surfaces 183 lying in generally radially extending planes. The cutting teeth 176 similarly include shearing surfaces 192 lying in generally radially extending planes. The cutting teeth 182 are wider than the opposed notches 174 in the opposed face of the outer hub 171 and the cutting teeth 176 of the outer hub are wider than the notches 181 in the sleeve 185. Accordingly, the cutting teeth 182 and 176 are prevented from intermeshing.

The central or hub portion 193 of the thrust washer 191 is journaled to the inner hub 163 of the propeller 161 such that the thrust washer 191 is positively rotationally driven by the inner hub 163 and cannot move circumferentially with respect to the inner hub 163. While various arrangements can be employed, engagement of the thrust washer 191 with hub 163 is provided in the embodiment of the invention shown in FIG. 2 by a pair of lugs or dogs 195 extending from the hub portion 193 of the thrust washer 191 into notches 197 in the opposed facing circumferential surface of the inner hub 163.

During operation, the thrust washer 191 rotates with the propeller 161 and the cutting teeth 182 of the thrust washer and cutting teeth 176 of the propeller 161 serve to cut or shred fish line or weeds which attempt to travel inwardly toward the inner cylindrical surface 21 of the gear case 17 and toward the propeller shaft 29.

Furthermore, the resilient cushion member 179, rotatably drivingly connecting the inner hub 163 to the intermediate hub 167 and the outer hub 171, permits relative circumferential movement between the inner hub 163 and the outer hub 171 of propeller 161 during acceleration or deceleration of the propeller shaft 29 and during an increase in the torque load on the propeller. Since the thrust washer 191 is journaled into the inner hub 163, such relative circumferential movement between the inner hub 163 and the outer hub 171 is translated to relative circumferential movement between the outer sleeve 185 of the thrust washer 191 and the outer hub 171. The consequent relative circumferential movement of the cutting teeth 182 supported by the aft face of the outer sleeve 185 and the cutting teeth 176 supported by the forward edge of propeller 161 functions to shear or shred fish line or weeds which attempt to travel inwardly toward the propeller shaft 29. Such cutting is specifically accomplished by a shearing action caused by relative movement of the shearing surfaces 183 of the cutting teeth 182 and the shearing surfaces 192 of the cutting teeth 176. The shearing surfaces 183 and 192 are planar and extend transversely to the peripheral surface of the sleeve 185 and the outer hub 172, respectively.

Figure 5:
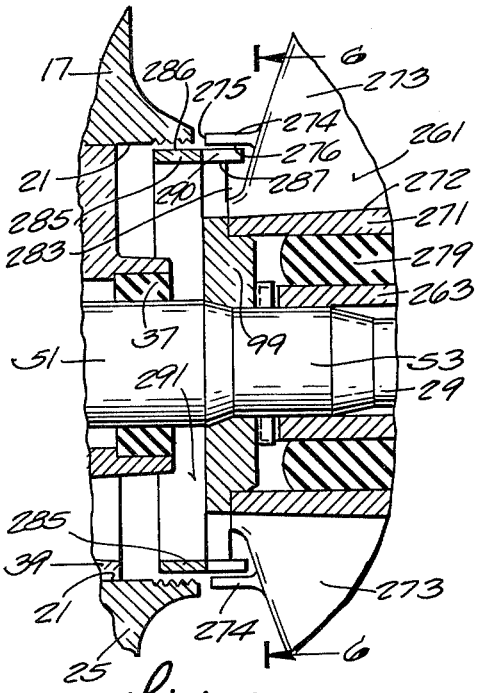
FIG. 5 is a fragmentary view similar to FIG. 2 illustrating a portion of another embodiment of a marine propulsion device which embodies various of the features of the invention.

FIG. 5 illustrates an alternative embodiment of the marine propulsion device shown in FIG. 2, which device is constructed in a similar manner to the device shown in FIG. 2 except that a different propeller 261 is employed and the thrust washer 291 includes alternative cutting surfaces.

The propeller 261 includes an inner part or hub 263 received on the propeller shaft 29 for common rotation therewith, an outer part or hub 271 having an outer surface 272 with a diameter materially less than the diameter of the inner cylindrical surface 21 of the gear case 17. One or more propeller blades 273 fixedly extend outwardly from the outer surface 272 of the outer hub 271. A resilient cushion 279 is positioned between the inner and outer hubs 263 and 271 so as to absorb shock and to permit a limited amount of relative rotation between the inner and outer hubs 263 and 271. As the outer surface 272 of the outer hub 271 of the propeller 261 has a diameter materially less than the diameter of the inner cylindrical surface 21 of the gear case 17, there is an annular space 283 outwardly of the outer surface 272 of the outer hub 272 and inwardly of the inner sylindrical surface 21 through which the exhaust gases and engine cooling water are discharged into the path of the radially inner part of the propeller blades 273.

Figure 6:
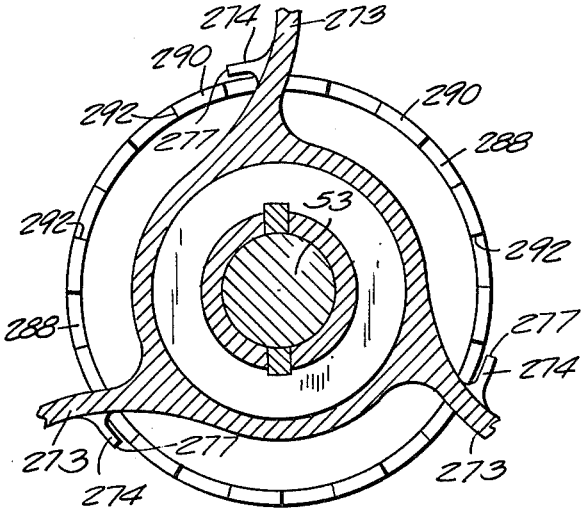
FIG. 6 is a cross-section view taken along line 6—6 in FIG. 5.

The propeller blades 273 are each provided with a forwardly extending cutting tooth 274 having a forward edge 275 adjacent to but spaced from the rearwardly facing gear case edge 23. The cutting teeth 274 extend forwardly from the forward edges of respective ones of the propeller blades 273 and also extend circumferentially from the propeller blades in the direction of rotation of the propeller as shown in FIG. 6.

The thrust washer 291 includes a radially outwardly spaced sleeve 285 having an outer cylindrical surface 286 closely spaced in inward telescopic relation to a part of the inner cylindrical surface 21 of the gear case 17 so as to closely clear or wipe the surface 21. The sleeve 285 also includes a rearwardly extending skirt portion 287 disposed such that a portion of the outer cylindrical surface 286 of sleeve 285 is closely spaced in inward telescopic relation to the cutting blades 274 of the propeller blades 273. The rearwardly extending portion 287 of the sleeve 285 includes a plurality of circumferentially spaced notches 288 in its rearward edge 280 defining a plurality of circumferentially spaced cutting teeth 290 extending rearwardly. The cutting teeth 274 of the propeller blades 273 each have a forwardly extending surface 275 in opposed, parallel adjacent relation with the rearwardly facing gear case edge or surface 23. The cutting teeth 274 also including a leading shearing edge 277 (FIG. 6) and a radially inner surface 276, the surfaces 276 of the cutting teeth 274 surrounding and in closely adjacent relationship with the rearwardly extending cutting teeth 290 of the sleeve 285 and forming opposed mating surfaces.

During operation, the rotation of the forwardly projecting cutting teeth 274 with the propeller 269 serves to cut or shred fish line or weeds which attempt to travel inwardly toward the inner cylindrical surface 21 of the gear case 17. Since the thrust washer 291 rotates with the propeller 261, the cutting teeth 290 and the ribs or spokes of the thrust washer 291 supporting the sleeve 285 also serve to shred fish line or weeds which attempt to travel inwardly.

Furthermore, the resilient cushion 279 provides for a flexible driving connection between the sleeve 285 and propeller blades 273 such that deceleration or acceleration of the propeller shaft or loading of the propeller 261 results in relative circumferential movement of the sleeve 285 and the propeller blades 273. The consequent relative movement between the cutting teeth 274 and 290 toward and away from each other causes shearing edges 277 and planar edges 292 to shear fish line or weeds which attempt to move inwardly toward the propeller shaft.

Figure 7:
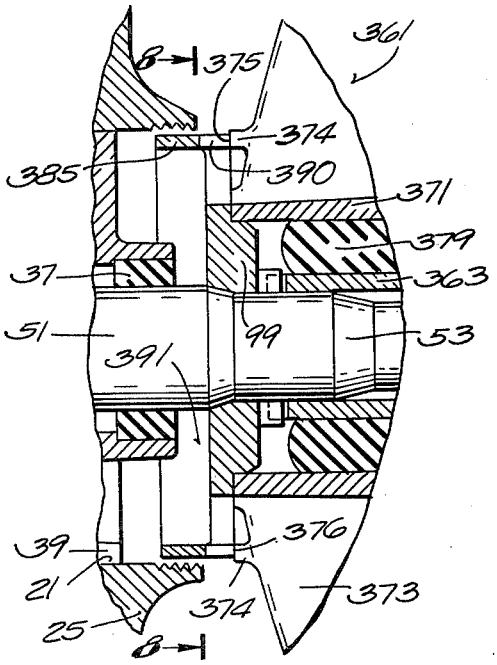
FIG. 7 is a fragmentary view similar to FIG. 2 illustrating still another embodiment of a marine propulsion device which embodies various of the features of the invention.
Figure 8:
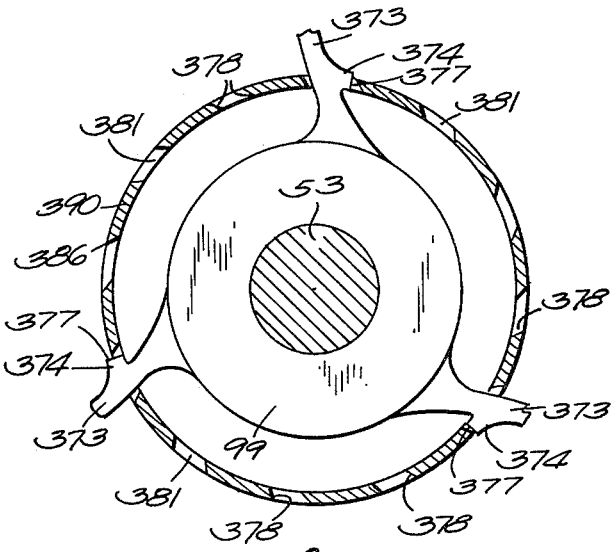
FIG. 8 is a cross-section view taken along line 8—8 in FIG. 7.

Fragmentarily shown in FIG. 7 is another marine propulsion device 311, similar to that shown in FIG. 4 but incorporating a propeller 361 having forwardly extending cutting teeth 374 which have a forward planar surface 375 in mating relationship with the rearward circumferential edge 376 of an outer sleeve 385 of a thrust washer 391. Like the cutting teeth 274 shown in the embodiment of the invention illustrated in FIGS. 5 and 6, the cutting teeth 374 extend forwardly from the leading edges of respective ones of a plurality of propeller blades 373 and also extend circumferentially therefrom. The cutting teeth 374 also each have a leading cutting surface 377 at their respective circumferential ends. The rearward edge 376 of the sleeve 385 includes cutting teeth 390 formed by a plurality of notches 381 in the rearward edge 376. As shown in FIG. 8, the cutting teeth 390 have shearing surfaces 378 inclined from the radial and inclined in the direction of rotation of the propeller 373, the shearing surfaces 378 including a leading cutting edge 386.

As in the case of the embodiments of the invention shown in FIGS. 2 through 6, cutting of fish line and weeds is accomplished by rotation of cutting teeth 374 and 390 with propeller 361. Furthermore, during acceleration or deceleration of the propeller, relative circumferential movement between the propeller blades 373 and the sleeve 385 also results in shearing movement of the cutting edges 377 of cutting teeth 374 with respect to cutting edges 378 of cutting teeth 390.

To preclude intermeshing of the forwardly extending teeth 375 of the propeller with the notches 381 in the rearward edge of sleeve 385, the cutting teeth 374 have a circumferential width greater than the width of the notches 381.

Various of the features of the invention are set forth in the following claims.

What is claimed is:

1. A marine propulsion device comprising a lower unit including a gear case including a hollow interior having at the rearward end thereof an inwardly extending inner circular surface defining an opening through which exhaust gases and engine cooling water are discharged from said lower unit, a propeller shaft rotatably journaled in said gear case and including a portion extending rearwardly of said gear case, a propeller including a hub mounted on said propeller shaft rearward portion for common rotation of said hub with said propeller shaft, a forward portion adjacent said rearward end of said gear case, and a propeller blade extending radially outwardly from said hub, a thrust washer carried by said propeller shaft in forward thrust transmitting engagement therewith and in forward thrust receiving engagement with said hub, and means for cutting fish lines and weeds including a sleeve supported by said thrust washer and extending into an area adjacent said inner circular surface of said gear case, said sleeve having a rearward cutting surface closely adjacent said forward portion of said propeller for cutting fish lines and weeds therebetween.

2. A marine propulsion device in accordance with claim 1 wherein said sleeve includes a rearward circumferential surface having circumferentially spaced cutting teeth thereon.

3. A marine propulsion device in accordance with claim 2 wherein said forward portion of said propeller includes cutting teeth thereon mating with said cutting teeth of said rearward surface.

4. A marine propulsion device in accordance with claim 1 wherein said hub includes an inner hub part mounted on said propeller shaft for rotation therewith, and an outer hub part supporting said cutting surface, said outer hub part including a forward circumferential surface positioned rearwardly of said sleeve, said forward circumferential surface supporting a plurality of circumferentially spaced cutting teeth in cutting relationship with said cutting surface.

5. A marine propulsion device as set forth in claim 1 wherein said sleeve includes a skirt extending rearwardly and wherein said skirt supports cutting teeth.

6. A marine propulsion device in accordance with claim 1 wherein said forward portion of said propeller blade supports thereon at least one forwardly projecting cutting tooth positioned in cutting relationship with said cutting surface of said sleeve.

7. A marine propulsion device as set forth in claim 6 wherein said forwardly projecting cutting tooth includes a circumferential cutting edge in cutting relationship with said cutting teeth supported by said sleeve.

8. A marine propulsion device in accordance with claim 1 wherein said thrust washer includes a central hub portion which transmits forward thrust from said propeller to said propeller shaft and a spoke extending radially outwardly from said central portion and supporting said sleeve, being said sleeve closely spaced from said inner cylindrical surface.

9. A marine propulsion device in accordance with claim 1 wherein said thrust washer includes a central hub portion, wherein said sleeve extends into the hollow interior of said gear case and has an outer cylindrical surface with a diameter slightly less than the diameter of said inner circular surface of said gear case, and wherein said thrust washer includes a radially extending rib connecting said central hub to said sleeve.

10. A marine propulsion device comprising a lower unit including a gear case including a hollow interior having at the rearward end thereof an inwardly extending inner circular surface defining an opening through which exhaust gases and engine cooling water are discharged from said lower unit, a propeller shaft rotatably journaled in said gear case and including a portion extending rearwardly of said gear case, a propeller including an inner hub part mounted on said propeller shaft rearward portion for common rotation of said inner part with said propeller shaft, an outer hub part, a propeller blade connected to said outer hub and extending radially outwardly, and resilient means connecting said inner and outer hub parts for limited relative rotational movement, a thrust washer carried by said propeller shaft in forward thrust transmitting engagement therewith, said thrust washer being rotatably driven by said inner hub part and being relatively rotationally movable with respect to said outer hub part and said propeller, and means for cutting fish lines and weeds including a sleeve supported by said thrust washer and extending into an area adjacent said inner circular surface of said gear case, said sleeve having a rearward cutting surface positioned closely adjacent said propeller for cutting fish lines and weeds therebetween during relative rotational movement of said thrust washer and said propeller.

11. A marine propulsion device in accordance with claim 10 wherein said sleeve includes a rearward circumferential surface having circumferentially spaced cutting teeth thereon.

12. A marine propulsion device in accordance with claim 11 wherein said propeller includes a forward portion having cutting teeth thereon mating with said cutting teeth of said rearward surface, said cutting teeth of said propeller and said sleeve respectively being movable circumferentially toward and away from each other during said relative rotational movement of said inner and outer hub parts.

13. A marine propulsion device in accordance with claim 10 wherein said outer hub portion includes a forward circumferential surface positioned rearwardly of said sleeve, said forward circumferential surface supporting a plurality of circumferentially spaced cutting teeth in cutting relationship with said cutting surface.

14. A marine propulsion device as set forth in claim 10 wherein said sleeve includes a skirt extending rearwardly and wherein said skirt supports cutting teeth.

15. A marine propulsion device as set forth in claim 10 wherein said forward portion of said propeller blades each support thereon at least one forwardly projecting cutting tooth positioned in cutting relationship with said cutting surface of said sleeve.

16. A marine propulsion device as set forth in claim 15 wherein said forwardly projecting cutting tooth includes a circumferential cutting edge in cutting relationship with said cutting teeth supported by said sleeve.

17. A marine propulsion device in accordance with claim 10 wherein said thrust washer includes a central hub portion which transmits forward thrust from said propeller to said propeller shaft and a spoke extending radially outwardly from said central portion and supporting said sleeve, said sleeve closely spaced from said inner cylindrical surface.

18. A marine propulsion device in accordance with claim 10 wherein said thrust washer includes a central hub portion, wherein said sleeve extends into the hollow interior of said gear case and has an outer cylindrical surface with a diameter slightly less than the diameter of said inner circular surface of said gear case, and wherein said thrust washer includes a radially extending rib connecting said central hub to said sleeve.

19. A marine propulsion device comprising a lower unit including a gear case including a hollow interior having at the rearward end thereof an inwardly extending inner cylindrical surface defining an opening through which exhaust gases and engine cooling water are discharged from the lower unit, a propeller shaft rotatably journaled in said gear case and including a portion extending rearwardly of said gear case, said rearwardly extending portion including a forward part having a first diameter, a rearward part having a second diameter of less dimension than said first diameter, and a thrust receiving transition part between said forward and rearward part, a propeller including an inner hub mounted on said propeller shaft rearward portion for common rotation of said inner hub with said propeller shaft, an outer hub having an outer surface with a diameter materially less than the diameter of said inner cylindrical surface of said gear case and having a forward end, a plurality of blades extending radially outwardly from said outer hub, and resilient means connecting said inner and outer hubs for limited relative rotational movement therebetween, a thrust washer carried by said propeller shaft and including a central portion including a thrust transmitting surface in engagement with said thrust receiving part of said propeller shaft and a thrust receiving surface in engagement with said forward end of said outer hub for transmitting thrust from said outer hub through said thrust washer to said propeller shaft, said thrust washer being rotationally movable with respect to said outer hub during said limited relative rotational movement of said inner and outer hubs, means positively connecting said inner hub and said thrust washer for common rotation, and means for cutting fish line and weeds including a sleeve supported by said thrust washer and extending into an area adjacent said inner circular surface of said gear case, said sleeve including a rearward cutting surface closely adjacent said propeller for cutting therebetween during relative rotational movement of said thrust washer and said propeller.

20. A marine propulsion device in accordance with claim 19 wherein said sleeve includes forward and rearward edges, and wherein said fish line and weed cutting means further includes first cutting teeth extending rearwardly from said rearward edge, and wherein said forward portion of said propeller includes cutting teeth mating with said first cutting teeth for cutting fish line and weeds.

* * * * *